US011495418B2

(12) United States Patent
Mora

(10) Patent No.: US 11,495,418 B2
(45) Date of Patent: Nov. 8, 2022

(54) MULTIPOLAR SWITCH

(71) Applicant: APEM, Caussade (FR)

(72) Inventor: Cédric Mora, L'honor de Cos (FR)

(73) Assignee: APEM, Caussade (FR)

( * ) Notice: Subject to any disclaimer, the term of this patent is extended or adjusted under 35 U.S.C. 154(b) by 0 days.

(21) Appl. No.: 16/952,732

(22) Filed: Nov. 19, 2020

(65) Prior Publication Data

US 2022/0181099 A1 Jun. 9, 2022

(30) Foreign Application Priority Data

Nov. 20, 2019 (FR) ..... 1912949

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2203/054* (2013.01); *H01H 2225/006* (2013.01); *H01H 2225/008* (2013.01)

(58) Field of Classification Search
CPC .. H01H 13/14; H01H 13/52; H01H 2225/006; H01H 2225/008; H01H 2203/054; H01H 13/46; H01H 13/48; H01H 13/26; H01H 13/50; H01H 2203/038; H01H 2205/032; H01H 2205/034; H01H 2013/525; H01H 2215/036; H01H 2215/012; H01H 2215/024; H01H 2215/004; H01H 2215/016; H01H 2215/018; H01H 2227/026; H01H 2227/022; H01H 2227/0261; H01H 2225/01; H01H 1/06; H01H 5/26; H01H 13/807; H01H 2205/018; H01H 2225/002;
(Continued)

(56) References Cited

U.S. PATENT DOCUMENTS 5,313,027 A 5/1994 Inoue et al.
5,898,147 A * 4/1999 Domzalski ..... H01H 13/807 200/1 B (Continued)

FOREIGN PATENT DOCUMENTS

DE 4304304 A1 9/1993
DE 202017104945 U1 9/2017
WO WO-2009/091394 A1 7/2009

*Primary Examiner* — Lheiren Mae A Caroc
(74) *Attorney, Agent, or Firm* — Marshall, Gerstein & Borun LLP

(57) ABSTRACT

A multipolar switch includes a first electrical contact zone connected to a first electrical circuit, and a second electrical contact zone connected to a second electrical circuit. In addition, a first part made from an electrically conducting material is arranged on and at a distance from the first electrical contact zone, and a second part made from an electrically conducting material is arranged on the first part.

An electrically insulating layer is arranged between the first part and the second part so as to electrically insulate them from one another.

So configured, the first part is configured to be elastically deformed when being mechanically solicited in an actuating direction of the multipolar switch, and the second part is configured to be elastically deformed or be displaced in the actuating direction of the multipolar switch, between a rest configuration and an activated configuration.

7 Claims, 7 Drawing Sheets

(58) Field of Classification Search
CPC ..... H01H 2205/02; H01H 2205/024; H01H 1/12; H01H 1/14; H01H 2215/034; H01H 2221/036; H01H 2221/044; H01H 2227/024; H01H 5/04; H01H 5/30; H01H 13/22; H01H 13/803; H01H 13/85; H01H 13/506
USPC ..... 200/5 A, 341, 520, 402, 405, 406, 408, 200/409, 238, 239, 243, 275, 513, 514, 200/516, 1 B, 5 B, 512, 515, 517
See application file for complete search history.

(56) References Cited

U.S. PATENT DOCUMENTS 6,936,777 B1 * 8/2005 Kawakubo ..... H01H 13/48 200/1 B
8,222,553 B2 * 7/2012 Zieder ..... H01H 13/807 200/406
10,460,890 B2 * 10/2019 Zimmer ..... H01H 13/14

* cited by examiner

[Fig. 1]
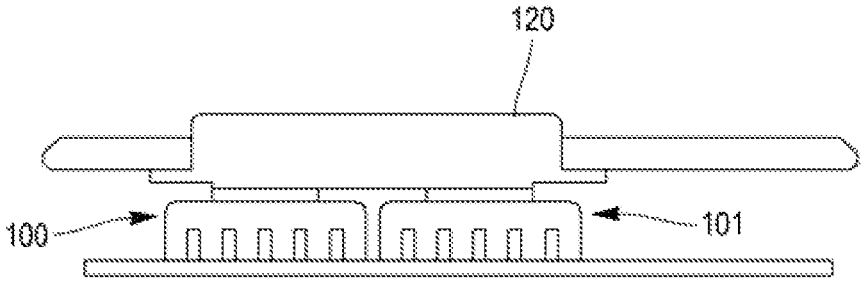
[Fig. 2]
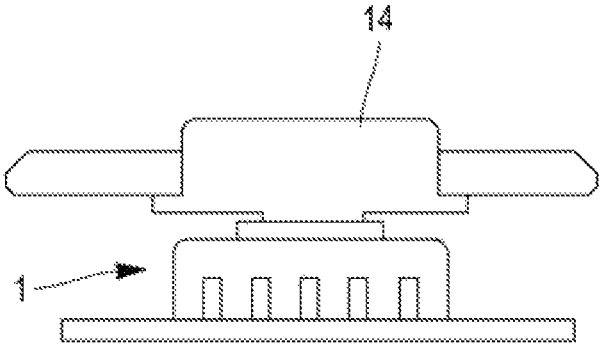
[Fig. 3A]
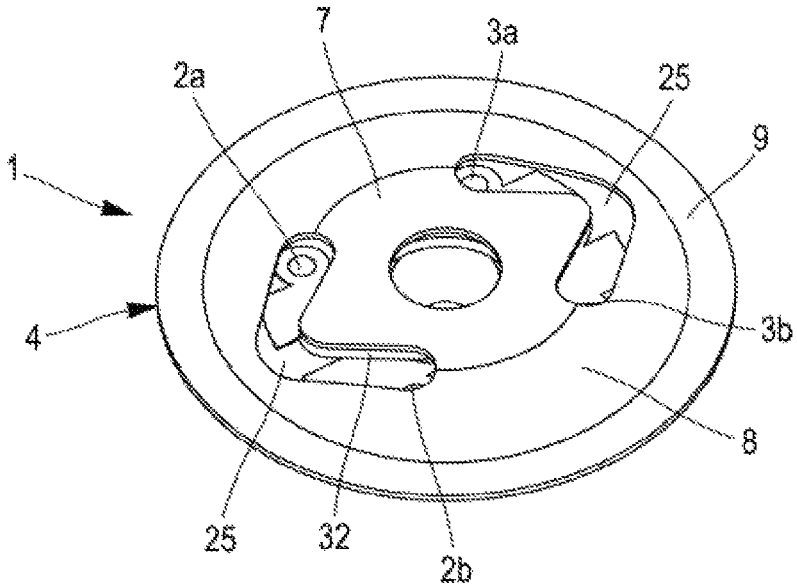

[Fig. 3B]
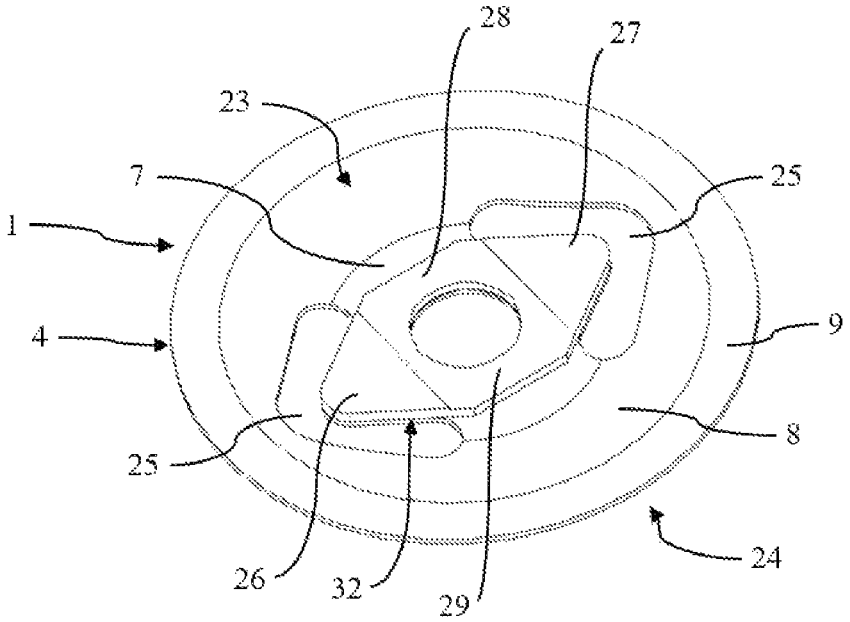
[Fig. 4]
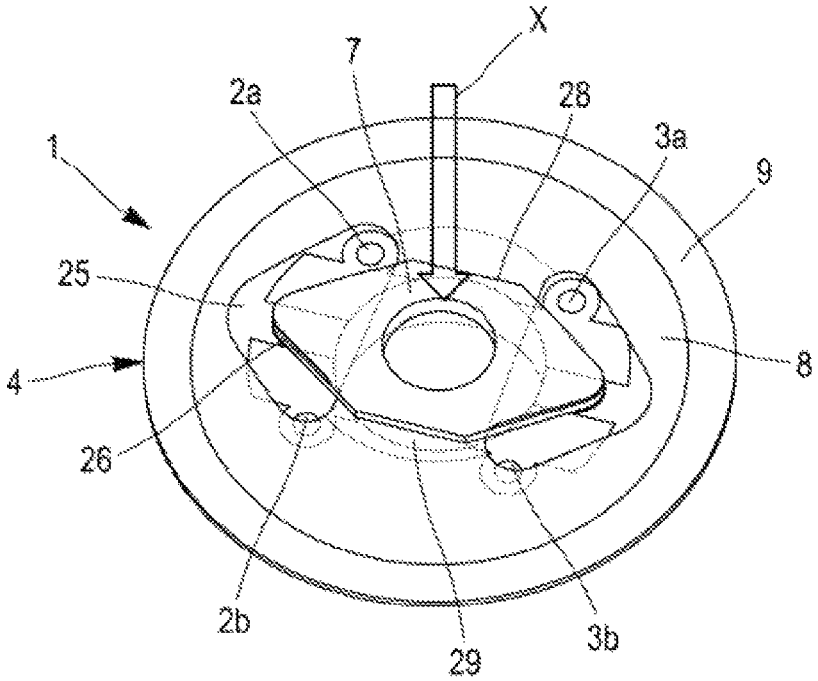

[Fig. 5]
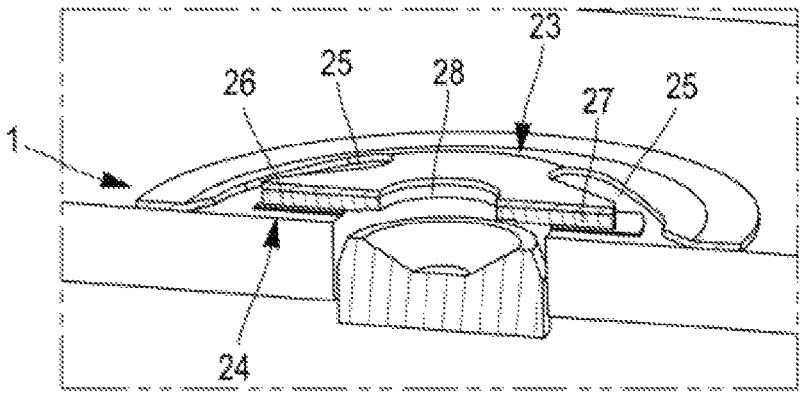
[Fig. 6]
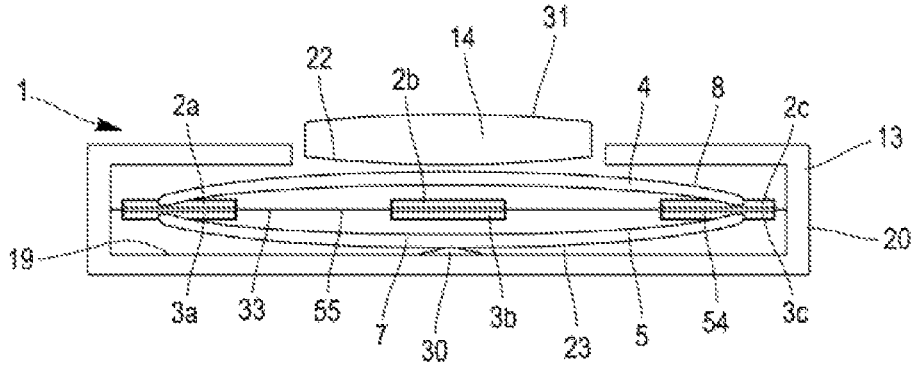
[Fig. 7]
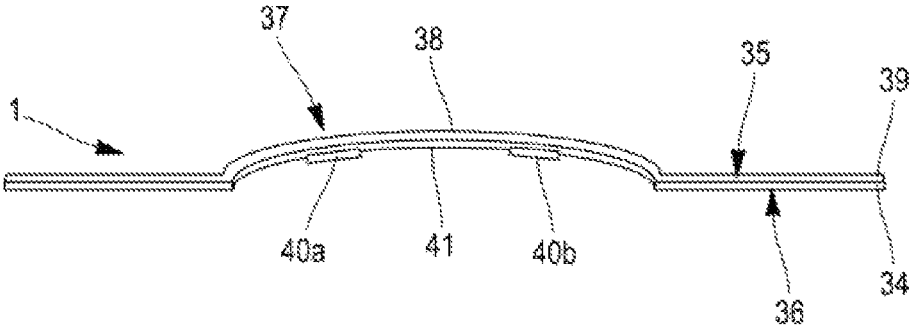

[Fig. 8]
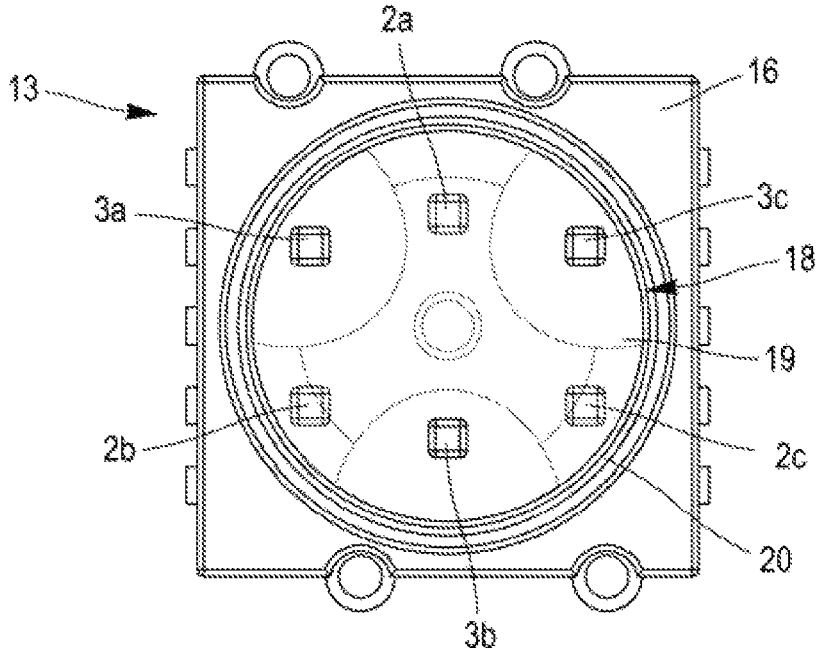
[Fig. 9]
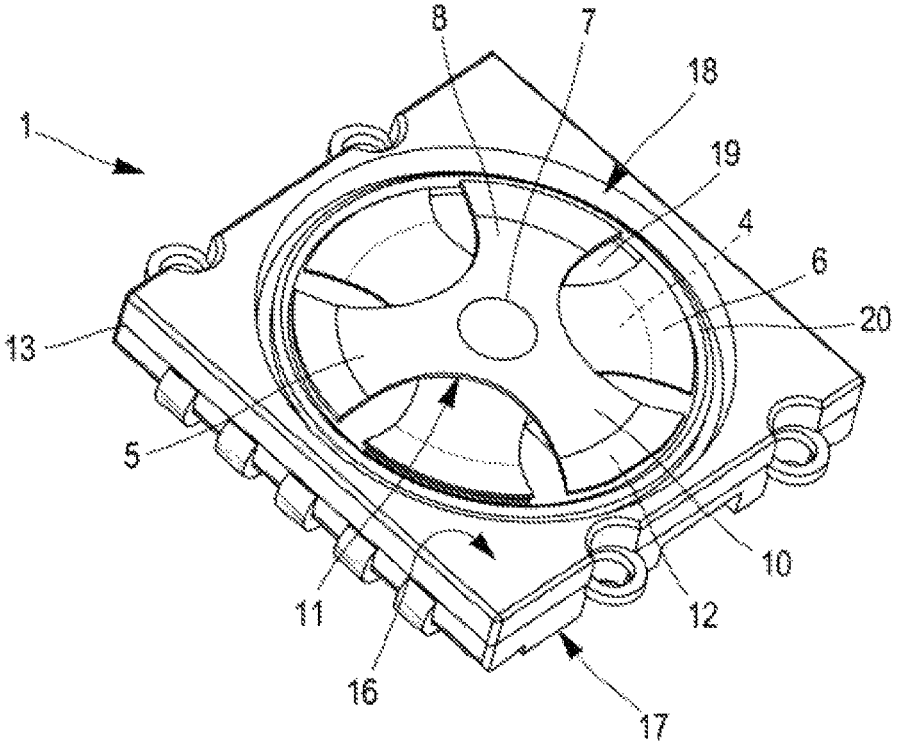

[Fig. 10]
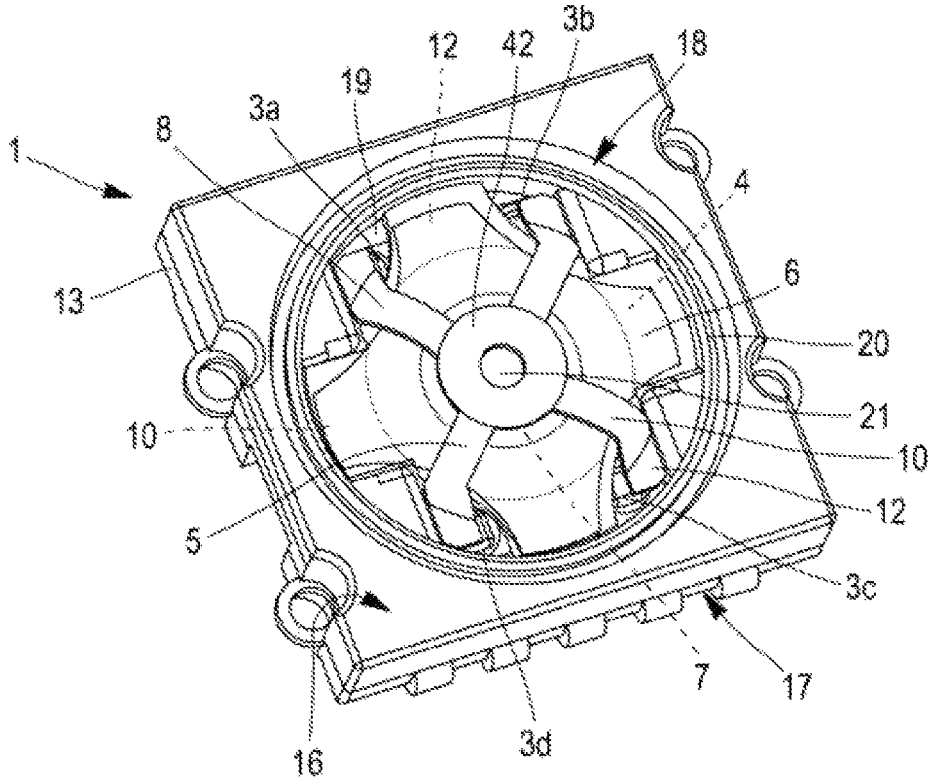
[Fig. 11]
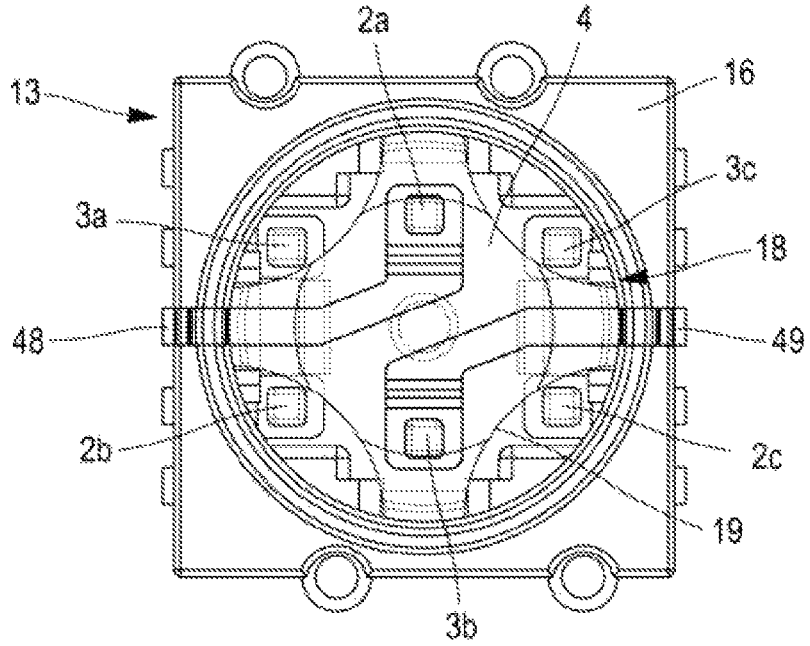

[Fig. 12]
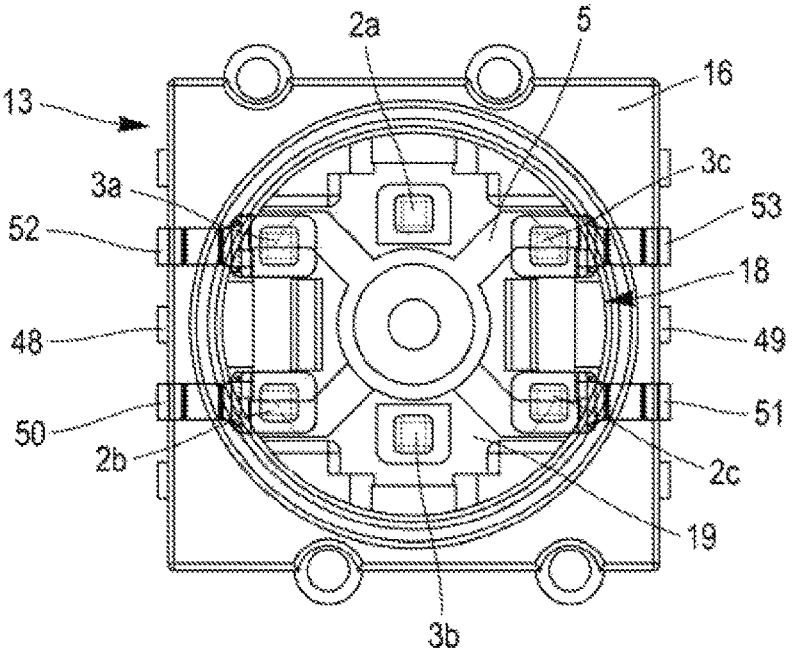
[Fig. 13]
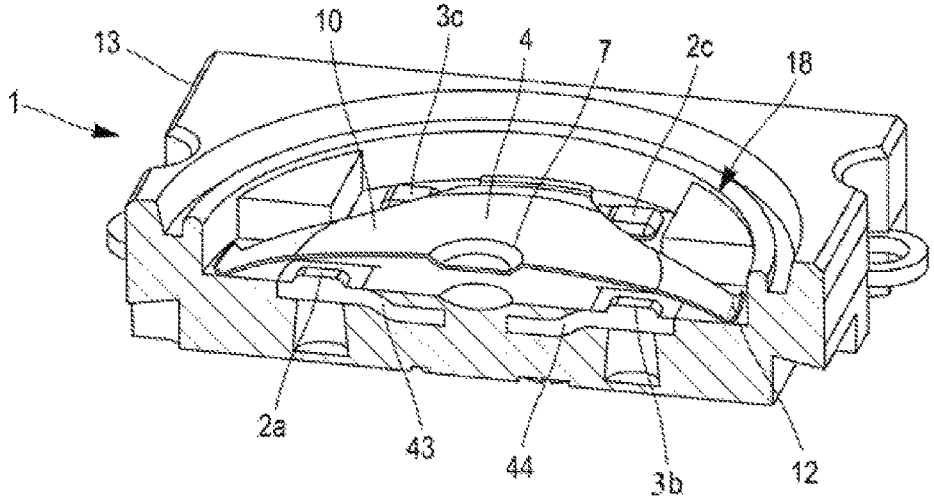
[Fig. 14]
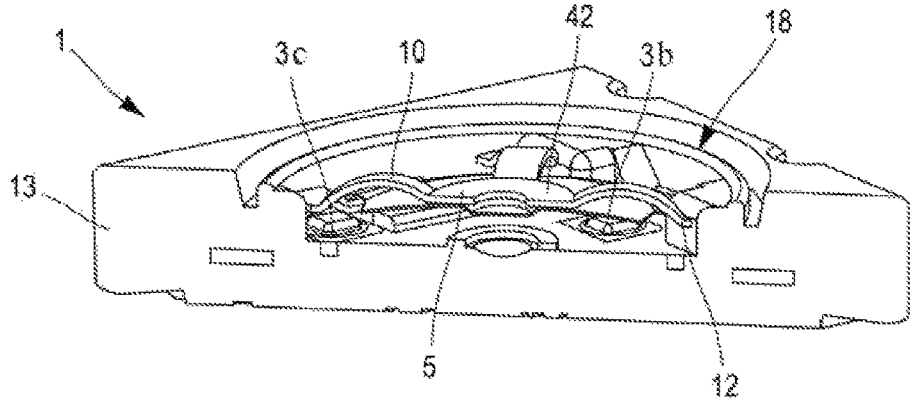

[Fig. 15]
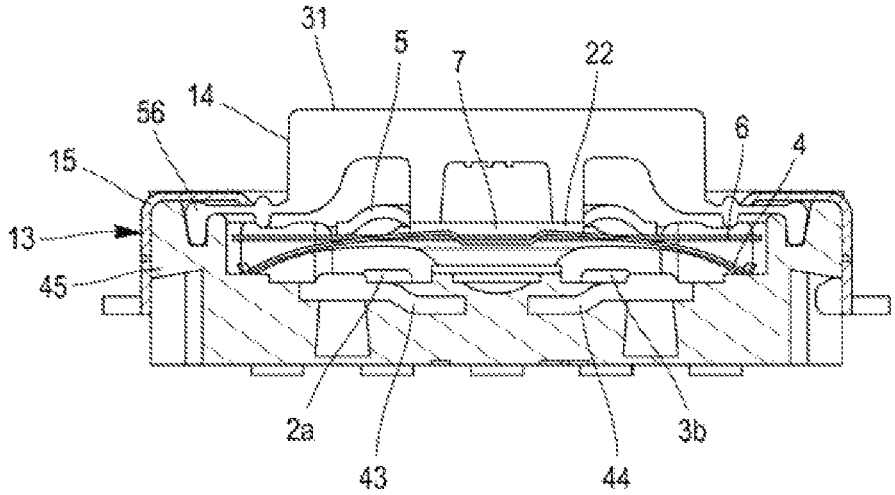
[Fig. 16]
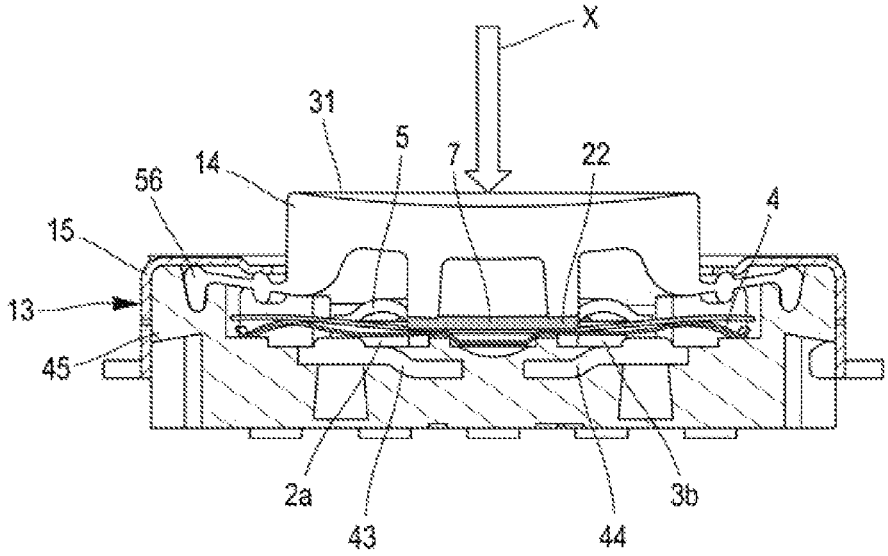

MULTIPOLAR SWITCH

CROSS REFERENCE TO RELATED APPLICATIONS

The benefit of priority to French Patent Application No. 1912949 filed Nov. 20, 2019, is hereby claimed and the disclosure is incorporated here in by reference in its entirety.

TECHNICAL FIELD OF THE INVENTION

The present invention relates to a multipolar switch for selectively opening or closing at least two electrical circuits.

BACKGROUND

Switches for industrial machines are widespread in industry. They are connected to the control system of the machine, and allow an operator to interact with the control system, in particular to stop the operation of the machine in the case of an emergency stop switch for example.

There are different mechanisms for actuating a switch (toggle switch, rotary switch, deformable membrane, etc.).

A particular type of switch comprises contact zones connected to an electrical circuit, and an actuator button mechanically connected to a part made from a conducting material. When a user actuates the actuator button by exerting a pressure on the latter, the actuator button is displaced or is deformed, and causes the part made of conducting material and the electrical circuit to be put into contact: the electrical circuit thus switches from the open state to the closed state.

An instruction corresponding to the function of the switch is sent to the control system that then controls the various effector members of the machine according to the instruction received.

In industry, industrial machines have to operate by ensuring maximum safety for users and for the surrounding personnel. That is why it is common to set up a redundancy of the electrical signal. Redundancy consists of doubling the information at the input of a system and/or the effector members at the output. Applied to a switch for an industrial machine, redundancy consists in doubling the number of electrical circuits for the carrying out of the same function. For example, two electrical circuits are used instead of a single electrical circuit to ensure the emergency stopping of a machine. Thus, if a failure is detected in the closure of one of the two electrical circuits, the instruction can even so be carried out thanks to the closure of the other electrical circuit, which improves safety.

Since there are two electrical circuits, it is necessary to provide two switches instead of a single switch, as shown in FIG. 1. A first switch 100 makes it possible to open or close the first electrical circuit, and a second switch 101 makes it possible to open or close the second electrical circuit. In order to ensure redundancy of the electrical signal, the two switches 100, 101 must be actuated simultaneously. Thus, a single actuator button 120 is generally provided that is common to the two switches. The actuating of this single actuator button makes it possible to simultaneously close the two electrical circuits.

The necessity of providing two switches instead of a single switch substantially increases the size of the actuating system within the industrial machine. This can generate additional constraints during the design and the manufacturing of the machine, and also during the use thereof.

Moreover, existing switches do not generally provide the user with a satisfactory force-feedback, in such a way that it is not always easy to detect the actuation, or the degree of actuation, of the switch by touch.

SUMMARY OF THE INVENTION

A purpose of the invention is to propose a multipolar switch that makes it possible to overcome the disadvantages described hereinabove.

The invention aims in particular to propose a multipolar switch that has a reduced size compared to known switches.

The invention aims very particularly to supply a multipolar switch that makes it possible to improve the tactile effect, also called the haptic effect, felt by a user when they actuate the switch.

For this purpose, the invention proposes a multipolar switch for selectively opening or closing at least two electrical circuits, comprising:

- at least one first electrical contact zone connected to a first electrical circuit, and at least one second electrical contact zone connected to a second electrical circuit, the first electrical circuit being electrically insulated from the second electrical circuit,
- a first part made from an electrically conducting material arranged on and at a distance from the first electrical contact zone, and a second part made from an electrically conducting material arranged on the first part made from an electrically conducting material,
- an electrically insulating layer arranged between the first and the second part made from an electrically conducting material so as to electrically insulate them from one another, wherein the first part made from an electrically conducting material is configured to be elastically deformed when it is mechanically solicited in an actuating direction of the switch, and the second part made from an electrically conducting material is configured to be elastically deformed or be displaced in an actuating direction of the switch, between a rest configuration wherein said first and second parts are separated from the first and second electrical contact zones, and an activated configuration wherein said first and second parts are respectively in contact with the first and second electrical contact zones so as to respectively close the first and second electrical circuits.

According to other aspects, the multipolar switch according to the invention presents the following various characteristics taken individually or in any technically admissible combination:

- the first part and/or the second part made from an electrically conducting material comprises a central portion, an intermediate portion which extends around the central portion, and a peripheral portion which extends around the intermediate portion, said part being dome-shaped at the central portion, the intermediate portion being configured to be deformed elastically with respect to the peripheral portion in such a way that the intermediate portion comes into contact with at least one respective electrical contact zone when said part is mechanically solicited;
- the first and the second part made from an electrically conducting material comprise a central portion, an intermediate portion which extends around the central portion comprising tabs separated from one another by notches, and a peripheral portion which extends around the intermediate portion comprising the ends of the tabs, the first and the second part being arranged in such a way that each tab of one of the first and second parts coincides with a notch of the other, and wherein the tabs of the second part, or the tabs of the first part and of the second part are configured to be elastically deformed with respect to the peripheral portion in such a way that each tab comes into contact with a respective first or second electrical contact zone in the activated configuration.

The switch further comprises:

a housing wherein are housed the first and second electrical contact zones and the first and second parts made from an electrically conducting material separated by the insulating layer, the peripheral portion of said first and second parts made from an electrically conducting material being fixed to the housing, an actuator button arranged on the housing, movable between a rest position wherein the first and the second electrical circuit are open, and an actuation position by application of a pressure by a user, wherein the first and the second part made from an electrically conducting material are mechanically solicited to deform them elastically with respect to the housing, so as to close the first and the second electrical circuit.

the switch further comprises:

a housing wherein are housed the first and second electrical contact zones and the first and second parts made from an electrically conducting material separated by the insulating layer, the peripheral portion of the second part being fixed to the housing, an actuator button arranged on the housing, movable between a rest position wherein the first and the second electrical circuit are open, and an actuation position by application of a pressure by a user, wherein the second part is mechanically solicited to displace it in the direction of actuation towards the first part in such a way as to exert a pressure against the first part, and the first part is mechanically solicited by the second part to deform it elastically with respect to the housing, so as to close the first and the second electrical circuit.

the second part made from an electrically conducting material is able to be deformed after coming into contact with the second electrical contact zones, during the actuation of the switch;

the actuator button is a push-button configured to return to its rest position from its actuation position when the user releases said push-button.

DESCRIPTION OF THE FIGURES

Other advantages and characteristics of the invention shall appear when reading the following description given as an example and in a non-limiting manner, with reference to the following accompanying figures:

FIG. 1 is a schematic representation showing two switches configured to close two separate electrical circuits simultaneously, according to the state of the art, FIG. 2 is a schematic representation showing a multipolar switch configured to close two separate electrical circuits simultaneously, according to the invention, FIG. 3A is a perspective view of the multipolar switch according to a first embodiment, wherein said switch comprises a metal cup coated with an electrically insulating film, the latter being coated with a conducting material, FIG. 3B is a perspective bottom view of the multipolar switch of FIG. 3A, FIG. 4 is a perspective view via transparency of the switch of FIG. 3A, FIG. 5 is a perspective view and as a cross-section of the switch of FIG. 3A, FIG. 6 is a schematic representation viewing from the side and as a cross-section the multipolar switch according to a second embodiment, wherein the switch comprises two metal cups positioned facing one another, separated by an insulating film, FIG. 7 is a schematic representation viewing from the side and as a cross-section the multipolar switch according to a third embodiment, wherein the switch comprises a thermoformed metallised film, FIG. 8 is a plane view of the housing of the multipolar switch showing the positioning of the electrical contact pads in said housing, FIG. 9 is a general view in perspective of the multipolar switch according to a fourth embodiment, FIG. 10 is a general view in perspective of the multipolar switch according to a fifth embodiment, FIG. 11 is a plane view of the multipolar switch of FIG. 10, on which the connections of the first part made from an electrically conducting material to its respective electrical contact zones can be seen via transparency, FIG. 12 is a plane view of the multipolar switch of FIG. 10, on which the connections of the second part made from an electrically conducting material to its respective electrical contact zones can be seen via transparency, FIG. 13 is a cross-section perspective view showing the mounting of a first part made from an electrically conducting material of the multipolar switch according to the fifth embodiment, FIG. 14 is a cross-section perspective view showing the mounting of a second part made from an electrically conducting material of the multipolar switch according to the fifth embodiment, FIG. 15 is a cross-section view of the multipolar switch according to the fifth embodiment, the switch being provided with an actuator button, the latter being in the rest position, FIG. 16 is a cross-section view of the multipolar switch according to the fifth embodiment, wherein the actuator button is in the actuation position.

DETAILED DESCRIPTION OF THE INVENTION

The invention relates to a multipolar switch for selectively opening or closing at least two electrical circuits. The two electrical circuits are electrically insulated from one another.

The multipolar switch 1 according to the invention is based on the principle of redundancy of the electrical signal, and makes it possible for this purpose to open or to close the two electrical circuits simultaneously (not shown), by actuation of the actuator button 14 of said switch, as shown in FIG. 2.

Then, a single switch 1 is sufficient to close the two electrical circuits, while two switches each opening or closing a respective electrical circuit were required in the state of the art. This leads to a reduction in the size of the actuation system within the industrial machine, and thus limits the constraints during the design and the manufacturing and the use of the industrial machine.

According to a first embodiment shown in FIGS. 3A, 3B, 4, and 5, the multipolar switch 1 comprises a part made from an electrically conducting material 4 that advantageously has the form of a metal cup, allowing a user to actuate the switch. This type of metal cup is known per se in the field of electronic devices.

The switch shown in FIGS. 3A, 3B, 4, and 5 is a switch of a LED. The switch according to the first embodiment is not however limited to a LED switch and the operation of such a LED shall not be described in the present text.

The cup 4 is advantageously preformed. It has the shape of a disc, comprising a central portion 7, an intermediate portion 8 which extends around the central portion, and a peripheral portion 9 which extends around the intermediate portion. The invention is not however limited to a cup that has the shape of a disc, and other shapes are suitable according to the type of switch, for example a square, rectangular or triangular shape.

The cup 4 is dome-shaped at the central portion 7. It has an upper face 23, and a lower face 24 opposite the upper face with respect to said cup.

The cup 4 is configured to be elastically deformed when it is mechanically solicited by a user in an actuating direction of the switch. The direction of actuation is represented by the arrow X in FIG. 4.

The mechanical effort is applied from the upper face 23 of the cup, which can be directly accessible by the user, or alternatively be provided with an actuator button (not shown) whereon the user can press to mechanically solicit the cup.

The cup 4 is then deformed at its intermediate portion 8, passing from a convex curvature wherein the central portion 7 is directed by moving away from the peripheral portion 9 according to the direction X, to a concave curvature wherein the central portion 7 is directed towards said peripheral portion 9. In other terms, the curvature of the cup is inverted: the latter switches from a convex curvature to a concave curvature by deformation of its intermediate portion. The central portion 7 is not deformed, or at the least, is deformed only very slightly.

"Elastic deformation" means the cup 4 returns to its original position when there is no longer any pressure exerted on it. This deformation is made possible by the material and the structure of the cup, wherein the intermediate portion is compresses and thus accumulates potential energy, which is then released when the user releases the pressure exerted on the cup, in the manner of a spring.

The transition of the cup 4 from the convex curvature to the concave curvature, during the deformation thereof, is felt by the user as a very slight jolt translating the maximum compression of the intermediate portion. The user thus feels a tactile or haptic effect, i.e. a force-feedback, when he presses on the cup to actuate the switch. The user then knows, without it being necessary to check it visually, that the cup is deformed and that the switch is actuated.

The cup 4 advantageously has recessed portions 25, that make it possible to improve its deformation, i.e., a reduced pressure is required from the user to obtain a deformation of the recessed cup similar to that of a solid cup.

The switch 1 further comprises electrical contact zones.

The electrical contact zones are located under the cup, facing the lower face 24 of said cup. In FIGS. 3A, 3B and 4, four electrical contact zones 2*a*, 2*b*, 3*ab*, 3*b* are present.

The first electrical contact zones 2*a*, 2*b* are electrically connected to a first electrical circuit, i.e. they comprise the first electrical circuit, and the second electrical contact zones 3*a*, 3*b* are electrically connected to a second electrical circuit (not shown), i.e. they form the second electrical circuit. The first and the second electrical circuit are electrically insulated from one another.

The switch 1 also comprises a film 32 that at least partially covers the lower face of the metal cup. The film 32 is particularly visible in FIG. 5 showing a cross-section view of the switch.

The film 32 comprises a first and a second electrically conducting portions 26, 27 electrically insulated from one another by a first and second electrically insulating portions 28, 29.

The first and second electrically conducting portions 26, 27 preferably comprise an electrically conducting material that covers the film 32.

The first and second electrically conducting portions 26, 27 preferably comprise metal tracks silkscreened on the film 32, preferably silver tracks.

Each electrically conducting portion 26, 27 is arranged in such a way as to come into contact with one or several respective electrical contact zones 2*a*, 2*b* and 3*a*, 3*b*, when the switch is actuated, so as to close the corresponding electrical circuit.

Thus, the first electrically conducting portion 26 is arranged at the intermediate portion 8 of the cup, in such a way as to come into contact with the first two electrical contact zones 2*a*, 2*b*, and the second electrically conducting portion 27 is arranged at the intermediate portion 8 of the cup, opposite the first electrically conducting portion 26 with respect to the centre of the cup 4, in such a way as to come into contact with the second two electrical contact zones 3*a*, 3*b*. The first and second electrically conducting portions 26, 27 are electrically insulated from one another by the two electrically insulating portions 28, 29 located between the latter.

The operation of the switch according to the first embodiment is as follows.

The switch 1 is initially at rest. The cup 4 is in a rest configuration wherein its central portion 7 and its intermediate portion 8 have a convex curvature. The cup 4, in particular the insulating film 32 covering its lower face, is separate from the electrical contact zones 2*a*, 2*b*, 3*a*, 3*b*.

When the user actuates the switch by exerting on the cup 4 a force oriented from its upper face 23 towards its lower face 24, said cup 4 is elastically deformed according to the force exerted by the user.

The intermediate portion 8 of the cup then takes a concave curvature.

The first electrically conducting portion 26 comes into contact with the two first electrical contact zones 2*a*, 2*b*, thus closing the first electrical circuit, and the second electrically conducting portion 27 comes into contact with the two electrical contact zones 3*a*, 3*b*, thus closing the second electrical circuit. The cup 4 is then in an actuating configuration, and the switch is actuated.

The force-feedback induced by the transition of the cup 4 between its rest configuration and its actuated position informs the user in a tactile manner of the actuation of the switch.

When the user releases the cup 4, the latter returns to its rest configuration. The switch 1 then returns to rest, thus reopening the two electrical circuits.

Then, the deformation of the cup 4 by actuation of the single switch 1 allows the user to simultaneously close the first and the second electrical circuit.

According to a second embodiment shown in FIG. 6, the multipolar switch 1 comprises two metal cups, of which a first cup 4 and a second cup 5.

The metal cups 4, 5 are similar to those described in the first embodiment, except that the latter are preferably solid.

Indeed, it is not necessary to make cuts in the cups to allow for the operation of the switch according to this second embodiment.

The first and the second cup 4, 5 are arranged one above the other, facing, the first cup 4 being located above the second cup 5.

The two cups 4, 5 are housed in a housing 13 provided with a bottom 19 delimited laterally by a lateral surface 20 that extends from the bottom 19 by moving away from the bottom. The peripheral portion 8 of the two cups 4, 5 is fixed to the housing.

The two cups 4, 5 are arranged in such a way that their convex curvature is separated from the median plane that extends between the two cups. The upper face of the first cup is therefore directed towards the top in the plane of the sheet, opposite the housing, while the upper face of the second cup is directed towards the bottom in the plane of the sheet, towards the bottom 19 of the housing.

The multipolar switch 1 further comprises a film 33 arranged between the two cups 4, 5.

The film 33 comprises first electrically conducting zones or portions 2*a*, 2*b*, 2*c* deposited on the upper face of the film facing the first cup 4, and second electrically conducting portion 3*a*, 3*b*, 3*c* deposited on the lower face of the film facing the second cup 5.

The first and second electrically conductrices portions 2*a*, 2*b*, 2*c*, 3*a*, 3*b*, 3*c* comprise more preferably metal tracks silkscreened on the film, more preferably silver tracks.

The first and second electrically conducting portions 2*a*, 2*b*, 2*c*, 3*a*, 3*b*, 3*c* are arranged on either side of the film 33, facing one another, at the peripheral portion 9 of the two cups 4, 5, and are then named peripheral electrically conducting portions 2*a*, 2*c*, 3*a*, 3*c*, and at the central portion 7 of the two cups, and are then named central electrically conductrices portions 2*b*, 3*b*.

The first electrically conducting portions 2*a*, 2*b*, 2*c* are electrically connected to a first electrical circuit (not shown), i.e. they form the first electrical circuit, and the second electrically conducting portions 3*a*, 3*b*, 3*c* are electrically connected to a second electrical circuit (not shown), i.e. they form the second electrical circuit.

The first electrically conducting portions 2*a*, 2*b*, 2*c* are respectively electrically insulated from the second electrically conducting portions 3*a*, 3*b*, 3*c* by electrically insulating portions 54 of the film that separate them, at the central portion 7 and the peripheral portion 9 of the cups.

The central electrically conductrices portions 2*b*, 3*b* are electrically insulated from the peripheral electrically conducting portions 2*a*, 2*c*, 3*a*, 3*c* by electrically insulating portions 55 of the film.

The upper face 23 of the second cup 5 is in contact with the bottom 13 of the housing, at its central portion 7. A lug 30 protruding from the bottom 19 of the housing is advantageously provided so as to be used as an abutment to the central portion 7 of the second cup.

The multipolar switch 1 further comprises an actuator button 14.

The actuator button 14 is mounted on the housing 13. It comprises an upper surface 31, and a lower surface 22 bearing against the upper surface of the first cup, at its central portion.

The actuator button 14 is movable by actuation between a rest position wherein the first and the second electrical circuit are open, and an actuation position by application of a pressure by a user on its upper face 31, wherein the cups 4, 5 are mechanically solicited to deform them elastically with respect to the housing 13, so as to close the first and the second electrical circuit.

The actuator button 14 is preferably a push-button configured to return to its rest position from its actuation position when the user releases said push-button.

The operation of the switch according to the second embodiment is as follows.

The switch 1 is initially at rest, as shown in FIG. 6. The two cups 4, 5 are in a rest configuration wherein their central portion 7 and their intermediate portion 8 have a convex curvature. The central portion 7 of each one of the two cups 4, 5 is separate from the central electrically conducting portions 2*b*, 3*b*.

When the user actuates the switch 1 by exerting on the actuator button 14 a force oriented from its upper face 31 towards its lower face 22, the first cup 4 is elastically deformed according to the force exerted by the user.

The central portion 7 and the intermediate portion 8 of the first cup 4 then have a concave curvature, and said central portion of the first cup comes into contact with the first central electrically conducting portion 2*b*, thus closing the first electrical circuit. The intermediate portion is deformed, while the central portion 7 is not deformed, or at the very least, is deformed only very slightly.

Given that the peripheral portions 9 of the two cups 4, 5 are in contact with one another, and that the abutment of the central portion 7 of the second cup 5 against the lug 30 of the bottom of the housing, the second cup 5 is deformed simultaneously with, and in a similar manner to, the first cup.

The central portion 7 of the second cup 5 comes into contact with the second central electrically conducting portion 3*b*, thus closing the second electrical circuit.

According to a third embodiment shown in FIG. 7, the multipolar switch 1 comprises an electrically insulating thermoformed film 34.

Such a thermoformed film 34 can be manufactured by heating the material so as to soften it, then by forming the material that has thus become ductile so that the latter takes a predefined shape, and retains it after cooling to ambient temperature.

Alternatively, the thermoformed film 34 can be cold-formed, i.e. at ambient temperature.

The material of the thermoformed film preferably comprises a thermoplastic polymer suitable for being formed by thermoforming.

The thermoplastic polymer is preferably chosen from: polystyrene (PS), polyethylene (PE), polypropylene (PP), polycarbonate (PC), acrylonitrile butadiene styrene (ABS), polyvinyl chloride (PVC), polymethyl methacrylate (PMMA), and mixtures thereof, present in the form of homopolymers or copolymers.

The thermoformed film 34 comprises an upper face 35 and a lower face 36 opposite the upper face with respect to the film.

The thermoformed film 34 comprises a dome-shaped portion 37, i.e. a convex protrusion that extends from a substantially planar portion of the film.

The dome-shaped portion 37 comprises a bearing surface 38 on the upper face 35 of the film, on which the user can press, by exerting a force oriented from the upper face towards the lower face of the film, so as to elastically deform the film.

The upper face 35 of the thermoformed film is advantageously covered, at least at the dome-shaped portion 37, with a metal layer 39 that makes it possible to reinforce the tactile effect during the actuation of the switch by deformation of the dome-shaped portion of the thermoformed film. The metal layer 39 is preferably deposited by metallisation of the upper surface of the thermoformed film, or by gluing.

The switch 1 further comprises at least two electrically conducting zones 40*a*, 40*b* arranged on the lower face of the thermoformed film, separated electrically from one another by an electrically insulating portion 41. The electrically conducting zones are configured to come into contact with a respective first and second electrical contact zone (not shown).

Preferably, the electrically conducting zones 40*a*, 40*b* are metal tracks silkscreened on the thermoformed film, more preferably silver tracks. The insulating portion 41 is formed more preferably from a portion of the thermoformed film.

The operation of the switch according to the third embodiment is as follows.

The switch 1 is initially at rest, as in FIG. 7. The thermoformed film 34 is in a rest configuration wherein the dome-shaped portion 37 has a convex curvature. The electrically conducting zones 40*a*, 40*b* are separated from the electrical contact zones.

When the user actuates the switch 1 by exerting on the dome-shaped portion 37 of the thermoformed film 34 a force oriented from its upper face 35 towards its lower face 36, said dome-shaped portion is elastically deformed according to the force exerted by the user.

The dome-shaped portion 37 then has a concave curvature, and the first and second electrically conducting zones 40*a*, 40*b* come respectively into contact with first and second electrical contact zones, thus closing the first and the second electrical circuit. The thermoformed film 34 is then in an actuation configuration, and the switch 1 is actuated.

The force-feedback induced by the transition of the dome-shaped portion 37 of the thermoformed film 34 between its rest configuration and its actuated configuration informs the user in a tactile manner of the actuation of the switch.

When the user releases the dome-shaped portion 37, the latter returns to its rest configuration. The switch 1 thus returns to rest.

According to a fourth embodiment shown in FIGS. 8 and 9, the multipolar switch 1 comprises two elastically deformable parts 4, 5 made from an electrically conducting material.

With reference to FIG. 8, the switch 1 comprises a housing 13 provided with an upper surface 16, a lower surface 17, and a blind orifice 18 that extends in the housing from the upper surface to the lower face. The orifice 18 is provided with a bottom 19 and with a lateral surface 20 that extends from the bottom to the upper surface of the housing.

The switch 1 further comprises at least one first electrical contact zone connected to a first electrical circuit, i.e. it forms the first electrical circuit, and at least one second electrical contact zone connected to a second electrical circuit, i.e. it forms the second electrical circuit. According to the fourth embodiment, the first and the second electrical contact zone have the shape of electrical contact pads 2*a*, 2*b*, 2*c*, and 3*a*, 3*b*, 3*c* arranged on the bottom 19 of the housing. The pads 2*a*, 2*b*, and 2*c* are connected to the first electrical circuit, and the pads 3*a*, 3*b*, and 3*c* are connected to the second electrical circuit. The first electrical circuit is electrically insulated from the second electrical circuit.

With reference to FIG. 9, the multipolar switch 1 comprises a first part made from an electrically conducting material 4 and a second part made from an electrically conducting material 5, which both have the form of a metal cup.

The metal cups are similar in their manufacture to those described in the first and in the second embodiments, but different from the latter in their form.

Indeed, the first and the second cup 4, 5 have the shape of a star with several branches 10, or tabs. In FIG. 9, the metal cups comprise three tabs.

The first and the second cup 4, 5 comprise a central portion 7 from which extend the three tabs 10 which form the intermediate portion 8 of the cup. The ends 12 of the tabs form the peripheral portion of the cup.

The first and the second cup 4, 5 are dome-shaped at their central portion 7. In other terms, the tabs 10 extend from the central portion 7 towards their ends 12 by curving in such a way as to move away longitudinally and transversally from said central portion.

The tabs 10 extend from the central portion 7 by flaring, i.e. by regularly widening in the direction of their end 12.

The tabs 10 are separated from one another by notches 11. The notches have a curved shape that corresponds to the flaring of the tabs 10.

The first and the second cup 4, 5 are able to be elastically deformed, by accumulation and release of potential energy, at their intermediate portion 8, i.e. at the tabs 10, switching from a convex curvature to a concave curvature. The central portion 7 is not deformed, or in the very least, is deformed only very slightly.

The transition of the cups 4 and 5 from a convex curvature to a concave curvature, during the deformation thereof, is felt by the user as a very slight jolt translating the maximum compression of the intermediate portion. The user this feels a haptic effect or force-feedback when he presses on the second cup 5 to actuate the switch. The user then knows, without it being necessary to check it visually, that the cups are deformed and that the switch is actuated.

The first cup 4 is arranged on and at a distance from the electrical contact pads 2*a*, 2*b*, 2*c*, 3*a*, 3*b*, 3*c*.

An electrically insulating layer 6 is arranged between the first 4 and the second cup 5 so as to electrically insulate them from one another.

The first cup 4 is arranged in such a way that its ends 12 face the first electrical contact zone in the direction of actuation. More precisely, each end 12 of the first cup faces a first corresponding electrical contact pad 2*a*, 2*b*, 2*c*.

The second cup 5 is arranged on the first metal cup 4, and is offset with respect to the latter by an angle determined according to an axis perpendicular to the longitudinal plane containing the central portion of the second cup. Due to this offset, each one of the ends 12 of the second cup 5 coincides with a corresponding notch 11 of the first cup 4, and each end 12 of the second cup 5 faces a second corresponding electrical contact pad 3*a*, 3*b*, 3*c*. In the embodiment shown in FIG. 9, the second cup 5 is offset by an angle of 60° with respect to the first cup 4.

The operation of the multipolar switch according to the fourth embodiment shall now be described.

The first and the second cup 4, 5 are initially in a rest configuration, wherein said parts are separated from the first and second electrical contact zones 2*a*, 2*b*, 2*c*, 3*a*, 3*b*, 3*c*. The first and the second electrical circuit are therefore open.

When the user exerts a pressure on the first cup 4, preferably via an actuator button such as shown in FIG. 15 in reference to a fifth embodiment described hereinafter, the actuator button switches from a rest position to an actuating position wherein it transmits the pressure of the user to the central portion 7 of the second cup 5.

More precisely, under the pressure of the actuator button 14, the second cup 5 is elastically deformed and presses against the first part 4, via the electrically insulating layer 6, thus causing the deformation of said first cup 4.

Under the effect of the mechanical pressure, and due to the pressing of the ends 12 of the tabs 10 of the first and second cups 4, 5 against the bottom 19 of the housing 13, the curvature of the first and second parts is inverted: the latter become concaves by deformation of their intermediate portion 8.

The first and second parts 4, 5 are then in an activated configuration.

In their activated configuration, the first cup 4 is in contact with the first electrical contact pads 2*a*, 2*b*, 2*c*, and the second cup 5 is in contact with the second electrical contact pads 3*a*, 3*b*, 3*c*, thus making it possible to respectively close the first and second electrical circuits.

FIG. 10 shows a fifth embodiment of the multipolar switch according to the invention.

The fifth embodiment differs from the fourth embodiment described hereinabove as for the structure of the first and second parts made from an electrically conducting material 4, 5.

The first part 4 comprises four tabs 10, and the latter extend from the central portion 7 of the part by thinning regularly in the direction of their end.

The first part 4 is dome-shaped at the level of its central portion 7, as shown in FIG. 13. In other words, the tabs 10 extend from the central portion 7 to their ends 12 by curving, in such a way as to move away longitudinally and transversally from said central portion.

The second part 5 has the form of an X, as shown in FIGS. 10 and 15. It comprises a central portion comprising a disc 42 pierced with an opening 21 in its centre, as well as an intermediate portion comprising four tabs 10 that extend from the central portion, to their ends 12 which form the peripheral portion of the part.

The tabs 10 are preferably dome-shaped so as to favour the elastic deformation of the first part.

As shown in FIG. 11, the first part 4 is arranged in such a way that two opposite ends 12 among its four ends each face a first electrical contact pad 2*a*, 3*b*. The electrical contact 2*a* is connected to a first electrical circuit via a terminal 48 located on the housing and protruding outwards from the latter. The electrical contact 3*b* is connected to the first electrical circuit via a terminal 49 located on the housing and protruding outwards from the latter.

The first part 4 is able to be elastically deformed, by accumulation and release of potential energy, at its intermediate portion 8, i.e. at its tabs 10, switching from a convex curvature to a concave curvature. Its central portion 7 is not deformed, or at the very least, is deformed only very slightly.

The transition of the first part 4 from a convex curvature to a concave curvature, during the deformation thereof, is felt by the user as a very slight jolt translating the maximum compression of the intermediate portion. The user thus feels a haptic effect or force-feedback when he presses on the second part 5 to actuate the switch. The user then knows, without it being necessary to check it visually, that the first part 4 is deformed and that the switch is actuated.

As shown in FIG. 12, the second part 5 is arranged on the first part 4 in such a way that each one of the ends 12 of the second part 5 coincides with a corresponding space between two consecutive tabs 10 of the first part 4. Each end 12 of the second part 5 faces a second corresponding electrical contact pad 2*b*, 2*c*, 3*a*, 3*c*. The electrical contacts 2*b*, 2*c*, 3*a*, 3*c* are connected to a second electrical circuit via respective terminals 50, 51, 52, 53 located on the housing and protruding outwards from the latter.

The connections of the first and second parts to the electrical contacts is not limited to those shown in FIGS. 11 and 12. The number of tabs of each part 4 and their connection to the electrical contacts of the housing can be adapted according to the number and the arrangement of said electrical contacts.

With reference to FIGS. 13 and 14 which show the mounting of the first and second parts 4, 5 in the housing 13, the central portion 7 of the first and of the second part is centred with respect to the housing.

The ends of the first part 4 are bearing against the bottom 19 of the housing 13, while their central portion is separated by a determined distance from the bottom 19 of the housing.

A thin (50 microns) and couple electrically insulating layer 6 is arranged between the first and the second part 4, 5 so as to electrically insulate them from one another.

The insulating film is high temperature (about 420° C.).

The second part 5 rests on the electrically insulating layer 6.

The multipolar switch 1 further comprises an actuator button 14 shown in the FIGS. 15 and 16. Although shown only for the fifth embodiment, the actuator button can also be present in the switch described according to the fourth embodiment, and is arranged in a manner similar notwithstanding the structural differences of the parts made from an electrically conducting material.

The actuator button 14 is arranged on the body 45. It comprises an upper surface 31, and a lower surface 22 bearing against the central portion 7 of the second part 5.

The actuator button 14 is movable by actuation between a rest position wherein the first 43 and the second electrical circuit 44 are open, and an actuation position by application of a pressure by a user on its upper face 31, wherein the first and the second part 4, 5 are mechanically solicited to deform them elastically with respect to the body 45, so as to close the first 43 and the second electrical circuit 44.

The actuator button 14 is preferably a push-button configured to return to its rest position from its actuation position when the user releases said push-button.

The multipolar switch further comprises a closing cover 15 that maintains the actuator button 14 against the body 45 of the housing in a sealed manner. The closing cover 15 makes it possible to maintain all the elements of the switch in the housing 13 in a sealed manner.

The actuator button 14 comprises at its periphery a membrane 56 that ensure the seal of the switch by being compressed between the body 45 of the housing and the closing cover 15.

The operation of the multipolar switch according to the fifth embodiment shall now be described with reference to FIGS. 15 and 16.

In FIG. 15, the actuator button 14 is in a rest position.

The first and the second part 4, 5 are in a rest configuration, wherein said parts are separated from the first and second electrical contact zones 2*a*, 2*b*, 2*c*, 3*a*, 3*b*, 3*c*. The first 43 and the second electrical circuit 44 are therefore open.

When the user exerts a pressure on the actuator button 14 of the switch, shown by the arrow X in FIG. 16, the actuator button 14 switches in its rest position to its actuation position wherein it transmits the pressure of the user to the central portion 7 of the second part 5. The second part 5 vertically translates, according to the direction of actuation of the switch by the user, i.e. in the direction of the first part 4.

More precisely, under the pressure of the actuator button 14, the second part 5 is displaced and presses against the first part 4, via the electrically insulating layer 6, thus causing the deformation of said first part 4. The second part 5 can be deformed slightly under the effect of the mechanical pressure.

The ends 12 of the second part 5 come into contact with electrical contact pads 2*b*, 2*c*, 3*a*, 3*c*, thus closing the first electrical circuit.

At the same time, under the effect of the mechanical pressure, and due to the pressing of the ends 12 of the tabs 10 of the first part 4 against the bottom 19 of the housing 13, the curvature of said first part is inverted: the latter becomes concave by deformation of its intermediate portion 8. The tabs 10 of the first part come into contact with the electrical contact pads 2*a* and 3*b*, thus closing the second electrical circuit.

The dome shape of the tabs 10 of the second part 5 make it possible to clear the first part 4 at its intermediate portion 8, which favours the elastic deformation of said first part and improves the haptic effect.

The first and second parts 4, 5 are then in an activated configuration, shown in FIG. 16. In this configuration, the first and second electrical circuits 43, 44 are closed.

Preferably, the second part 5 is able to be deformed after coming into contact with the second electrical contact pads 2*b*, 2*c*, 3*a*, 3*c*, during the actuation of the switch. This additional deformation, or after travel, of the second part 5 makes it possible to improve the electrical contact between the latter and the second electrical contact pads 2*b*, 2*c*, 3*a*, 3*c*, as well as between the first part 4 and the first electrical contact pads 2*a*, 3*b*, given that the second part 5 transfers the force due to the actuating of the switch to the first part 4, thus causing the deformation of the latter.

The invention claimed is:

1. A multipolar switch comprising:

a first electrical contact zone connected to a first electrical circuit;

a second electrical contact zone connected to a second electrical circuit, the first electrical circuit being electrically insulated from the second electrical circuit, the second electrical contact zone comprising a plurality of electrical contact pads;

a first part made from an electrically conducting material arranged on and at a distance from the first electrical contact zone;

a second part made from an electrically conducting material arranged on the first part, the second part comprising a central portion and a plurality of tabs, each tab of the plurality of tabs extending from the central portion to an end of the tab, the end facing an electrical contact pad of the plurality of electrical contact pads; and an electrically insulating layer arranged between the first part and the second part so as to electrically insulate them from one another;

wherein the first part is configured to be elastically deformed when being mechanically actuated in an actuating direction of the multipolar switch, and the second part is configured to be elastically deformed or be displaced in the actuating direction of the multipolar switch, between a rest configuration wherein the first part and the second part are separated from the first electrical contact zone and the second electrical contact zone, and an activated configuration wherein the first part and the second part are respectively in contact with the first electrical contact zone and second electrical contact zone so as to respectively close the first electrical circuit and the second electrical circuit.

2. The multipolar switch according to claim 1, wherein the first part and/or the second part comprises a central portion, an intermediate portion which extends around the central portion, and a peripheral portion which extends around the intermediate portion, the first part being dome-shaped at the central portion, the intermediate portion being configured to be deformed elastically with respect to the peripheral portion in such a way that the intermediate portion comes into contact with at least one of the first electrical contact zone and second electrical contact zone when the first part and/or the second part is mechanically actuated.

3. The multipolar switch according to claim 1, wherein the first part and the second part each comprises a central portion, an intermediate portion which extends around the central portion and comprises tabs separated from one another by notches, and a peripheral portion which extends around the intermediate portion and comprises ends of the tabs, the first part and the second part being arranged in such a way that each tab of one of the first part and second part coincides with a respective notch of another one of the first part and the second part, and wherein the tabs of the second part, or the tabs of the first part and of the second part, are configured to be elastically deformed with respect to the peripheral portion of the respective first part and/or second part in such a way that each tab of the tabs of the second part, or the tabs of the first part and of the second part, comes into contact with the respective first electrical contact zone or second electrical contact zone in the activated configuration.

4. The multipolar switch according to claim 1, further comprising:

a housing, the first electrical contact zone, the second electrical contact zone, the first part and the second part being housed in the housing;

an actuator button arranged on the housing and movable, by application of a pressure by a user, between a rest position wherein the first electrical circuit and the second electrical circuit are open, and an actuation position wherein the second part is mechanically actuated to be displaced in a direction of actuation towards the first part in such a way as to exert a pressure against the first part, and the first part is mechanically actuated by the second part to be deformed elastically with respect to the housing so as to close the first electrical circuit and the second electrical circuit.

5. The multipolar switch according to claim 4, wherein the second part is able to be deformed after coming into contact with the second electrical contact zone during actuation of the multipolar switch.

6. The multipolar switch according to claim 4, wherein the actuator button is a push-button configured to return to a rest position from an actuation position when the user releases said push-button.

7. A multipolar switch comprising:

a housing;

a first electrical contact zone connected to a first electrical circuit, the first electrical contact zone comprising a plurality of first electrical contact pads arranged on a bottom of the housing;

a second electrical contact zone connected to a second electrical circuit, the first electrical circuit being electrically insulated from the second electrical circuit, the second electrical contact zone comprising a plurality of second electrical contact pads arranged on a bottom of the housing;

a first part made from an electrically conducting material arranged on and at a distance from the first electrical contact zone, the first part being housed in the housing;

a second part made from an electrically conducting material arranged on the first part, the second part being housed in the housing; and an electrically insulating layer arranged between the first part and the second part so as to electrically insulate them from one another;

wherein the first part is configured to be elastically deformed when being mechanically actuated in an actuating direction of the multipolar switch, and the second part is configured to be elastically deformed or be displaced in the actuating direction of the multipolar switch, between a rest configuration wherein the first part and the second part are separated from the first electrical contact zone and the second electrical contact zone, and an activated configuration wherein the first part and the second part are respectively in contact with the first electrical contact zone and second electrical contact zone so as to respectively close the first electrical circuit and the second electrical circuit.

* * * * *